United States Patent [19]

Murase et al.

[11] Patent Number: 4,858,720

[45] Date of Patent: Aug. 22, 1989

[54] NOISE REDUCING APPARATUS

[75] Inventors: Masanori Murase, Tokyo; Naotaka Tomita, Sayama; Keiichiro Mizuno, Ohta; Kazuyoshi Iida, Yokohama, all of Japan

[73] Assignee: Bridgestone Corporation, Tokyo, Japan

[21] Appl. No.: 120,437

[22] Filed: Nov. 13, 1987

[30] Foreign Application Priority Data

Nov. 15, 1986 [JP] Japan ..... 61-270921

[51] Int. Cl.[4] ..... G10K 11/06

[52] U.S. Cl. ..... 181/176; 181/175

[58] Field of Search ..... 181/175, 176, 286; 367/132, 150

[56] References Cited

U.S. PATENT DOCUMENTS 4,553,629 11/1985 Sternberg ..... 181/176

FOREIGN PATENT DOCUMENTS 2004170 3/1979 United Kingdom ..... 181/176

OTHER PUBLICATIONS

Japanese Patent Application Laid-Open No. 60-85043.

Japanese Patent Application Laid-Open No. 61-18997.

*Primary Examiner*—B. R. Fuller

*Attorney, Agent, or Firm*—Sughrue, Mion, Zinn, Macpeak & Seas

[57] ABSTRACT

A noise reducing apparatus is disclosed, comprising a lens-type hollow body consisting of a plurality of inclined hollow tubular passages. The lens-type hollow body has a plane incident surface and a curved emission surface and the length $L_2$ of the hollow tubular passage is optimized in accordance with relevant dimensional parameters of setting of the lens-type hollow body in a sound field, to reduce noise from a spot sound source efficiently.

1 Claim, 3 Drawing Sheets

NOISE REDUCING APPARATUS

BACKGROUND OF THE INVENTION

1. Field of the Invention

The invention relates to a noise reducing apparatus, particularly to a noise reducing apparatus of the type comprising a lens-type hollow body for converging incident noises from a sound source.

2. Related Art Statement

Hitherto, a noise reducing apparatus of the type comprising the above-described lens-type hollow body has been well known as disclosed in Japanese Utility Model Application Publication No. 24,716/83. Such a noise reducing apparatus, as shown in FIG. 5, comprises a lens-type hollow body 2 consisting of a plurality of inclined hollow tubular passages 1 having different lengths, and the lens-type hollow body 2 has a convex lens-shaped cross section having a plane incident surface 2*a* opened towards a sound source and a hyperbolic curved emission surface 2*b* on the opposite side. Such a convex lens-type hollow body 2 is arranged in a sound field such that parallel waves A from the noise source enter to the openings 1*a* at the incident surface side of the hollow tubular passages directed to the noise source, so that the sound waves passing through the hollow tubular passages 1 of the lens-type hollow body 2 are focused, behind the lenstype hollow body 2. Therefore, it is possible to absorb and reduce noises by arranging a sound absorbing material 3 at a focus F.

However, when noises are generated from an approximate actual sound source such as a vehicle engine, radiator, muffler, pump and the like, the sound waves spherically emit from the spot sound source. It has been confirmed from experiments that when the above-described conventional convex lens-type hollow body 2 is arranged in a sound field where the noises are emitted spherically from the spot sound source, as shown in FIG. 6, sound waves passed through the hollow tubular passages of the convex lens-type hollow body 2 are emitted from an emission surface 2*b* as shown by an arrow B and cannot be focused

SUMMARY OF THE INVENTION

An object of the invention is to provide a noise reducing apparatus comprising a lens-type hollow body consisting of inclined hollow tubular passages having a focusing effect in a sound field where the sound waves are spherically emitted from a spot sound source as described above.

According to the invention, the sound reducing apparatus comprises a lens-type hollow body consisting of a plurality of inclined hollow tubular passages, and having an incident surface and an emission surface either one of which is formed of a plane and the other is formed of a curved surface, wherein a length $L_2$ of any hollow tubular passage of the lenstype hollow body is represented by the following formula (1)

$$L_2 = \frac{(L - L_1)^2 - f^2 - S^2}{2\{(L - L_1) - f\cos\theta - S \cdot \sin\theta\}} \quad (1)$$

where, $L_1$: a distance from a spot sound source to an opening of any hollow tubular passage, $L = (l^2 + a^2/4)0.5 + (f^2 + a^2/4)\ 0.5$ S: a distance from the center of the incident surface of the lens-type hollow body to the opening of any hollow tubular passage, f: a distance from the incident surface to the focus, l: a distance from the spot sound source to the incident surface, a: a a height of the lens-type hollow body, and $\theta$: an inclined angle of the hollow tubular passage, and a tolerance of the length $L_2$ is $\pm 15\%$.

With the sound reducing apparatus in accordance with the present invention, when noise spherically emitted from the spot sound source passes through the hollow tubular passages having different lengths determined by the equation (1), within a triangular zone defined by lines connecting the upper and lower ends of the lens-type hollow body and the focus, the noise can be converged to and focussed at the focus. Accordingly, the focussed noise can be absorbed by providing a sound absorbing material at the position of the focus to reduce noise within the triangular zone. Without the triangular zone, noise passing through the hollow tubular passages interferes with noise directly propagated without passing the hollow tubular passages from the spot sound source to reduce the noise.

DESCRIPTION OF THE PREFERRED EMBODIMENTS

The present invention will be described in reference to the accompanying drawings.

Figure 1:
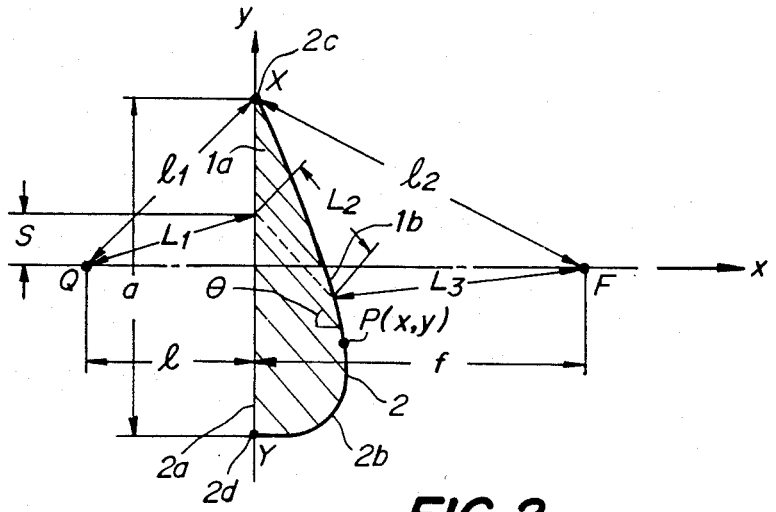
FIG. 1 is a schematic cross-sectional view of the lens-type hollow body according to the invention.

Referring to FIG. 1, a noise reducing device according to the invention having a lens-type hollow body 2 consisting of a plurality of inclined hollow tubular passages 1*a*. The lens type hollow body 2 is constructed according to the above mentioned formula (1) so that sound waves propagated from the left side of the lens-type hollow body 2 after passing through the lens-type hollow body 2 are converge at a focus F at a predetermined distance $L_3$ from the lens-type hollow body 2 in a predetermined direction. The position of the focus F is determined by the relation such as the following equation (2).

$$l_1 + l_2 = L_1 + L_2 + L_3 \quad (2)$$

where, $l_1$: longer one of distances between the upper and lower ends of the lens-type hollow body 2 and the spot sound source Q, $l_2$: longer one of distances between the upper and lower ends of the lens-type hollow body 2 and the focus F, $L_l$: a distance from the spot sound source Q to the opening 1*a* of any hollow tubular passage 1*a*, $L_2$: a length measured on the longitudinal axis of any hollow tubular passage 1, and $L_3$: a distance from the exit lb of the above tubular passage 1 to the focus F.

From the equation (2), the length $L_2$ of the hollow tubular passage 1a of the device is represented by the equation(1), thereby determining a cross section of the lens-type hollow body 2. Further, at the outside of a triangular zone (XYF) defined by lines connecting both upper and lower ends 2*c*, 2*d* of the lens-type hollow body and the focus F, controlled sound waves passed through the hollow tubular passages 1a and a non-controlled sound waves (diffraction wave) not passing through the hollow tubular passages 1 are out of phase and interfere with each other, and thereby a destructive interference phenomenon occurs. As a result, the outside of the triangular zone (XYF) becomes a sound damping zone, and the zone of sounds is converged and controlled within the triangular zone. Therefore, if the focus F is separated from the height of an ear, noises felt by man can be reduced, and moreover, if a sound absorbing material such as glass wool and the like is provided at the position of the focus F, noises can be focused to and absorbed by the sound absorbing material.

EXAMPLE

A number of hollow tubular passages 1*a* of 42 mm×60 mm in cross section are superimposed one upon the other at an inclined angle of $\theta=65°$ into a lens-type hollow body 2 having a height "a" of 600 mm according to the equation (1) as shown in FIG. 1.

The lens-type hollow body 2 is placed at a position where a distance l from a spot sound source Q to an incident surface 2*a* to 150 mm. When the central frequency (Hz) of the spot sound source Q is changed variously, sound pressure at the point of 100 mm from the incident surface 2*a* and 30 mm from an X axis is measured, and the result thereof is plotted in FIG. 2.

Figure 2:
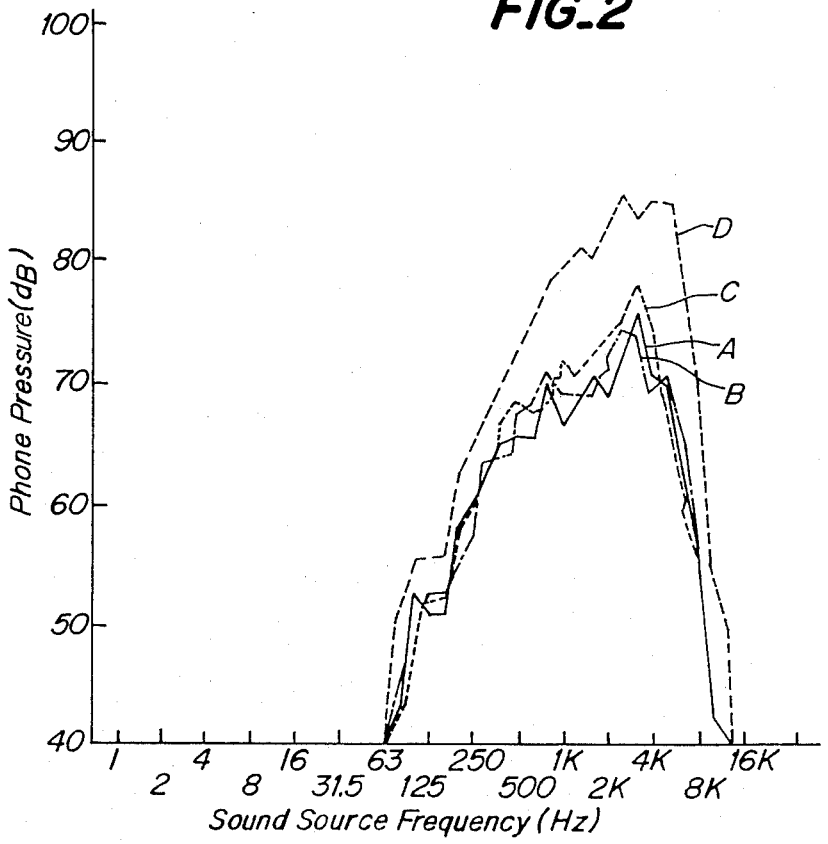
FIG. 2 is a graph showing the noise reducing effect of the lens-type hollow body according to the invention.

In FIG. 2, a curve A shows a sound pressure level when a length of any hollow tubular passage 1*a* of the lens-type hollow body 2, i.e., a length $L_2$ measured on the longitudinal axis of the hollow tube path 1 is determined by the equation (1), a curve B shows a sound pressure level when the length is 15% longer than the length $L_2$ of the hollow tubular passage determined by the equation (1), a curve C is a sound pressure level when the length is 15% shorter than the length $L_2$, and a curve D is a sound pressure level when no lens-type hollow body is provided, respectively.

As apparent from FIG. 2, within the variable range of ±15% of the length $L_2$ of the hollow tubular passage of the lens-type hollow body 2 determined by the equation (1) according to the invention, it is possible to obtain a noise reducing effect equal to that of the hollow tubular passage length $L_2$ by the equation (1).

Therefore, according to the invention, the length $L_2$ of the optional hollow tubular passage by the equation (1) has an allowable range of the length of ±15%, that is, a tolerance.

Figure 3A:
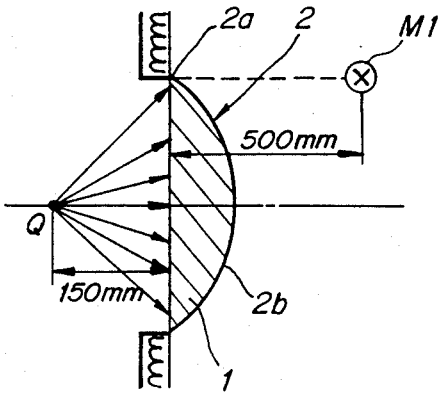
FIG 3a PRIOR ART
FIG. 3*a* shows an arrangement of lens-type hollow body according to the prior art used in comparative tests mentioned later.
Figure 3B:
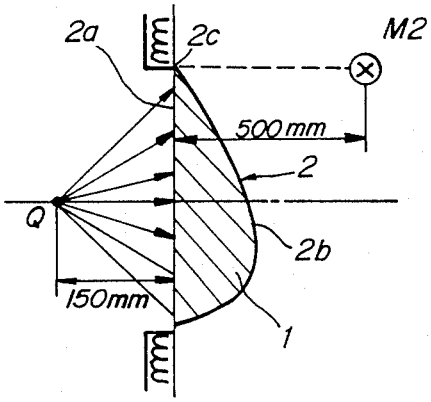
FIG. 3*b* shows an arrangement of lens-type hollow body according to the present invention used in the comparative test.
Figure 4:
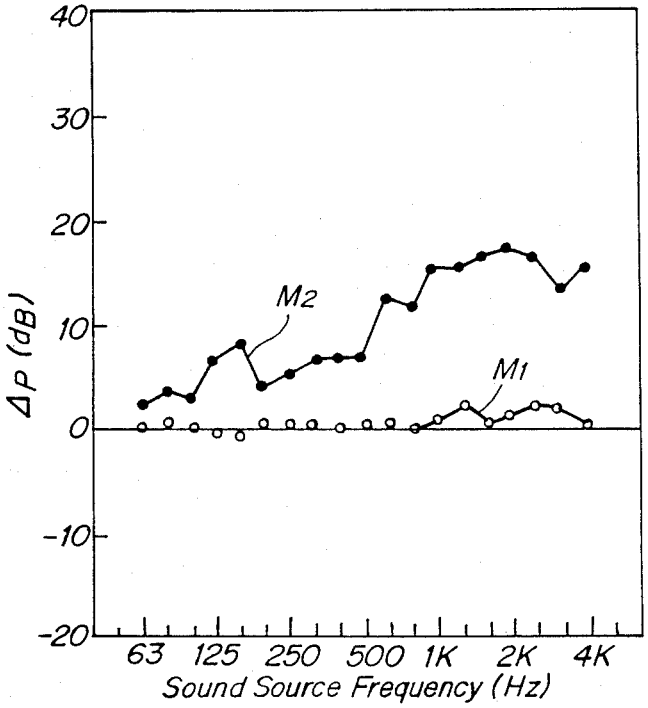
FIG. 4 is a graph showing results of the comparative test between the lens-type hollow body according to the prior art shown in FIG. 3*a* and the lens-type hollow body according to the present invention shown in FIG. 3*b.
Figure 5:
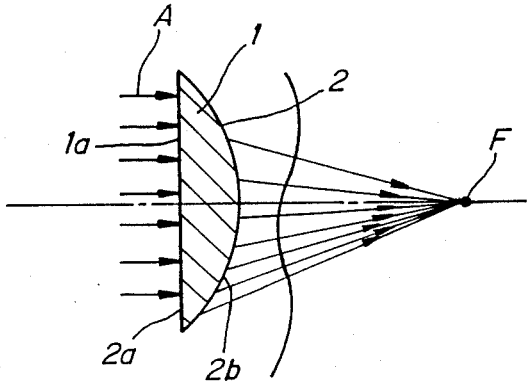
FIG. 5 PRIOR ART
* and FIGS. 5 and 6 are views explaining the function of the prior art lens-type hollow body.
Figure 6:
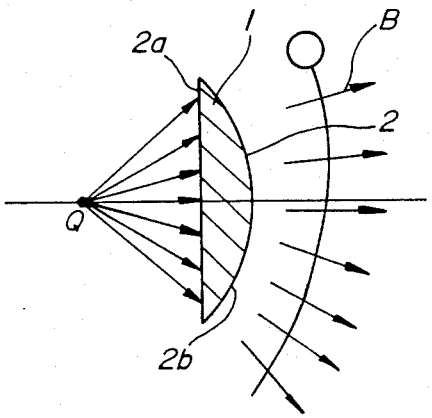
FIG. 6 PRIOR ART

In order to confirm an effect of the invention, as shown in FIGS. 3*a* and 3*b*, a change of a sound pressure level at mikes $M_1$, $M_2$ was measured by setting the prior convex lens-type hollow body 2 having the hyperbolic emission surface 2*b* and the lens-type hollow body 2 having the hollow tubular passage length by the equation (1) of the invention at the position of 150 mm from the spot sound source Q to the incident surface 2*a*, respectively, setting the mikes $M_1$ and $M_2$ at the height equal to the upper ends 2*c* of the lens-type hollow body 2 within a vertical plane spaced 500 mm from the incident surface 2*a* measured on the focal side, and changing frequency of the spot sound source Q. The measured results are compared and shown in FIG. 4. In FIG. 4, ΔP shows a sound pressure level difference obtained by subtracting the sound pressure level in case of setting the lens-type hollow body from the sound pressure level in case of setting no lens-type hollow body. In the graph, the curve $M_1$ shows a sound pressure level difference in the mike $M_1$, and the curve $M_2$ shows a sound pressure level difference in the mike $M_2$, respectively.

As apparent from the graph of FIG. 4, the prior art hyperbolic lens-type hollow body scarcely shows a noise reducing effect at the point of the mike $M_1$, but the lens-type hollow body having the hollow tubular passage length by the equation (1) of the invention shows a remarkable noise reducing effect at the point of the mike $M_2$.

As described above, according to the invention, noise spherically emitted from the spot sound source can be focused behind the lens-type hollow body, a sound reducing zone can be produced outside the triangular zone defined by lines connecting both the upper and lower ends of the lens-type hollow body and the focus, and an extremely excellent noise reducing effect can be obtained.

What is claimed is:

1. A noise reducing apparatus comprising; a lens-type hollow body consisting of a plurality of inclined hollow tubular passages, and having an incident surface and an emission surface at opposite sides thereof, respectively, one of the surfaces being formed of a plane surface and the other thereof being formed of a curved surface, wherein a length $L_2$ of any hollow tubular passage of the lens-type hollow body is represented by the following formula (1)

$$L_2 = \frac{(L - L_1)^2 - f^2 - S^2}{2\{(L - L_1) - f\cos\theta - S \cdot \sin\theta\}} \quad (1)$$

where, $L_1$: a distance from a spot sound source to an opening of any hollow tubular passage, $L=(l^2+a^2/4)0.5+(f^2+a^2/4)0.5$ S: a distance from a center of the incident surface of the lens-type hollow body to an opening of any hollow tubular passage, F: a distance from the incident surface to a focus, l: a distance from a spot sound source to the incident surface, a: a height of the lens-type hollow body, and $\theta$: an inclined angle of the hollow tubular passage, and a tolerance of the length $L_2$ is +15%, whereby noise passing through said hollow tubular passages is converged and focused at a focus point of the lens-type hollow body to be absorbed at the focus point.

* * * * *